US009802303B2

(12) United States Patent
Vanstaan et al.

(10) Patent No.: US 9,802,303 B2
(45) **Date of Patent: *Oct. 31, 2017**

(54) INTERFACE FOR FUEL DELIVERY SYSTEM FOR COMBUSTION FASTENER DRIVER

(71) Applicant: Illinois Tool Works Inc., Glenview, IL (US)

(72) Inventors: Valery H. Vanstaan, Highland Park, IL (US); Maureen Louise Shea, Wilmette, IL (US); Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 761 days.

This patent is subject to a terminal disclaimer.

(21) Appl. No.: 14/195,338

(22) Filed: Mar. 3, 2014

(65) Prior Publication Data

US 2014/0175143 A1 Jun. 26, 2014

Related U.S. Application Data

(63) Continuation-in-part of application No. 13/271,995, filed on Oct. 12, 2011, now Pat. No. 8,939,339, which (Continued)

(51) Int. Cl.

| | |
|---|---|
| ***B25C 1/08*** | (2006.01) |
| ***B25C 1/04*** | (2006.01) |
| ***B25D 9/10*** | (2006.01) |

(52) U.S. Cl.

CPC ..... *B25C 1/08* (2013.01)

(58) Field of Classification Search

CPC ..... B25C 1/08; B25C 1/04; B25D 9/10

(Continued)

(56) References Cited

U.S. PATENT DOCUMENTS

| | | | |
|---|---|---|---|
| 3,035,617 | A | 5/1962 | Breitenstein |
| 3,884,256 | A | 5/1975 | Corlet |

(Continued)

FOREIGN PATENT DOCUMENTS

| | | |
|---|---|---|
| DE | 10 2009 008169 | 9/2010 |
| EP | 1 327 501 | 7/2003 |
| WO | 03/053637 | 7/2003 |

OTHER PUBLICATIONS

International Search Report and Written Opinion for International Application No. PCT/US2014/069111, dated Mar. 11, 2015 (10 pages).

(Continued)

*Primary Examiner* — Michelle Lopez

(74) *Attorney, Agent, or Firm* — Neal, Gerber & Eisenberg LLP

(57) ABSTRACT

A fuel delivery system for use with a combustion fastener driver including a cylinder head frame, the system includes a fuel cell with an outer shell having a closed lower end and an open upper end, a closure crimped over the upper end and defining an opening for accommodating a reciprocating valve stem, a fuel cell adapter frictionally engaging the closure and including a flange configured for suspending the fuel cell in a tool fuel cell chamber. The adapter includes a collar configured for receiving the valve stem and being suspended for restricted vertical movement relative to the flange. A stem receiver block is connectable to the cylinder head frame and includes a stem engagement portion configured for directly and sealingly engaging an end of the valve stem, the stem engagement portion being in fluid communication with an internal receiver passage constructed and arranged for delivering fuel to a combustion chamber.

18 Claims, 12 Drawing Sheets

Related U.S. Application Data is a continuation-in-part of application No. 12/759,340, filed on Apr. 13, 2010, now Pat. No. 8,302,831.

(58) Field of Classification Search
USPC ..... 227/8–10; 123/46 SC
See application file for complete search history.

(56) References Cited

U.S. PATENT DOCUMENTS

| | | | | |
|---|---|---|---|---|
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| 5,115,944 | A | 5/1992 | Nikolich | |
| 5,263,439 | A | 11/1993 | Doherty et al. | |
| 5,484,088 | A | 1/1996 | Martin | |
| 6,145,724 | A | 11/2000 | Shkolnikov et al. | |
| 6,217,314 | B1 | 4/2001 | Kiesinger et al. | |
| 6,302,297 | B1 | 10/2001 | Richardson et al. | |
| 6,679,414 | B2 | 1/2004 | Rotharmel | |
| 6,796,478 | B2 | 9/2004 | Shkolnikov et al. | |
| 6,889,731 | B2 | 5/2005 | Vallon et al. | |
| 7,296,719 | B1 | 11/2007 | Taylor et al. | |
| 7,392,922 | B2 | 7/2008 | Vanstaan et al. | |
| 7,445,136 | B2 | 11/2008 | Lin | |
| 7,478,740 | B2 | 1/2009 | Shea | |
| 7,546,938 | B2 | 6/2009 | Panasik et al. | |
| 7,571,841 | B2 | 8/2009 | Gibson et al. | |
| 7,591,249 | B2 | 9/2009 | Wagdy et al. | |
| 7,654,429 | B2 | 2/2010 | Shea | |
| 7,661,568 | B2 | 2/2010 | Vanstaan et al. | |
| 7,841,499 | B2 | 11/2010 | Ho | |
| 7,841,500 | B2 | 11/2010 | Ho | |
| 8,302,831 | B2 * | 11/2012 | Taylor | B25C 1/08 227/10 |
| 8,939,339 | B2 * | 1/2015 | Vanstaan | B25C 1/08 227/10 |
| 2002/0043547 | A1 | 4/2002 | Shkolnikov et al. | |
| 2003/0127488 | A1 | 7/2003 | Wagdy | |
| 2005/0000711 | A1 | 1/2005 | Hurlstone et al. | |
| 2006/0186166 | A1 | 8/2006 | Akiba | |
| 2007/0246571 | A1 | 10/2007 | Marion et al. | |
| 2008/0000451 | A1 | 1/2008 | Shea et al. | |
| 2008/0110953 | A1 | 5/2008 | Gibson et al. | |
| 2008/0166600 | A1 | 7/2008 | Tanaka | |
| 2009/0001120 | A1 | 1/2009 | Shea et al. | |
| 2010/0096429 | A1 | 4/2010 | Ho | |
| 2010/0155406 | A1 | 6/2010 | Ho | |
| 2011/0248063 | A1 | 10/2011 | Taylor et al. | |
| 2012/0267417 | A1 | 10/2012 | Vanstaan et al. | |

OTHER PUBLICATIONS

Office Action for German Application No. 11 2011 100 056.1, dated Jan. 12, 2016 (7 pages).

* cited by examiner

INTERFACE FOR FUEL DELIVERY SYSTEM FOR COMBUSTION FASTENER DRIVER

RELATED APPLICATION

This application is a Continuation-in-Part of U.S. patent application Ser. No. 13/271,995 filed Oct. 12, 2011, which is a Continuation-in-Part of U.S. patent application Ser. No. 12/759,340 filed Apr. 13, 2010, now U.S. Pat. No. 8,302,831.

BACKGROUND

The present invention relates generally to improvements in fuel cell fuel delivery arrangements for use in combustion tools, and more specifically to adapters provided to combustion tool fuel cells for obtaining more consistent fuel dosing.

In the present application the term "combustion nailer" refers to combustion powered fastener driving tools, also known as fastener drivers, combustion tools, cordless framing tools, cordless trim tools and the like. More particularly, the present invention relates to improvements in the delivery of fuel from fuel cells customarily provided for such purposes.

Such tools typically have a housing substantially enclosing a combustion power source, a fuel cell, a battery, a trigger mechanism and a magazine storing a supply of fasteners for sequential driving. The power source includes a reciprocating driver blade which separates a forward most fastener from the magazine and drives it through a nosepiece into the workpiece. Exemplary tools are described in U.S. Pat. Nos. 4,483,473; 4,522,162; 6,145,724; and 6,679,414, all of which are incorporated by reference. Such fastener-driving tools and such fuel cells are available commercially from ITW-Paslode (a division of Illinois Tool Works, Inc.) of Vernon Hills, Ill., under its IMPULSE trademark.

As exemplified in Nikolich U.S. Pat. Nos. 4,403,722; 4,483,474; and 5,115,944, all of which are also incorporated by reference, it is known to use a dispenser such as a fuel cell to dispense a hydrocarbon fuel to a combustion tool. A design criterion of such fuel cells is that only a desired amount of fuel or dose of fuel should be emitted by the fuel cell for each combustion event. The amount of fuel should be carefully monitored to provide the desired combustion, yet in a fuel-efficient manner to prolong the working life of the fuel cell.

Prior attempts to address this dosage factor have resulted in fuel metering valves located in the tool (U.S. Pat. No. 5,263,439) or attached to the fuel cell (U.S. Pat. No. 6,302,297), both of which are also incorporated by reference. Fuel cells have been introduced having internal metering valves, as disclosed in U.S. Pat. No. 7,392,922, also incorporated by reference. Other combustion tool fuel delivery arrangements are disclosed in U.S. Pat. Nos. 7,478,740; 7,571,841; 7,591,249; 7,654,429; and 7,661,568, all of which also being incorporated by reference.

Regardless of the location of the metering valve, the associated combustion nailer is designed to exert a force on the valve, either the reciprocating valve stem or on the valve body itself, to cause the stem to retract against a biasing force in the metering valve to dispense a measured dose of fuel. It is important for fuel economy in the fuel cell, and for desired operation of the combustion nailer, that only the designated amount of fuel to be supplied to the tool on a dosage basis.

Designers of such tools are focused on maintaining a sealed relationship in the fuel delivery system for more efficiently using fuel in the fuel cells, and in particular when the tool is used at relatively cooler ambient temperatures (below about 50° F., 10° C.). Another drawback of conventional systems is that when the fuel cell stem is provided with an adapter extension, in some cases the fuel cell stem is exposed to external accidental contacts. Such external accidental contacts may unintentionally dispense fuel, or damage or even break the fuel stem, leaving the fuel cell unusable.

Another factor faced by designers of such tools relates to an inherent aspect of manufactured plastic parts, known as tolerance buildup. Components need to be designed to accommodate a range of dimensions for various components to account for manufacturing tolerances. In the present operational environment, the engagement between the fuel cell valve stem and the corresponding fuel delivery components and passages of the tool needs to be maintained in a positive, fluid communicative relationship, while both preventing leaks and also while accommodating such dimensional component variations. In addition, the fuel delivery system should also be designed to maintain the fuel flow in the face of severe impact forces generated in the combustion process.

SUMMARY

To more accurately maintain the relationship between the fuel cell metering valve stem and the corresponding actuation mechanism on the tool, the current fuel system includes two elements: a fuel cell stem receiver block connected to the tool combustion chamber and also directly in contact with the fuel cell stem, and a fuel cell adapter which securely engages an upper peripheral ring of the fuel cell. A direct connection between the stem receiver block and the fuel cell stem reduces the chances for fuel leakage and also reduces the number of components of the fuel delivery system, since a separate fuel stem adapter is no longer needed.

Further, a vertically projecting, generally tubular cowl-like collar projects vertically from an upper surface of the fuel cell adapter and protects the fuel cell stem from accidental contact which might damage the stem's sealing surface, or more seriously, may damage the stem itself. Another advantage of the collar is that it cooperates with, and accommodates reciprocal movement of the stem receiver block in defining a vertical stroke track for the guiding the block during the fuel dispensing process. Unlike previous stem receiver blocks made of plastic, the present block is made of metal, preferably aluminum or zinc, which, when properly configured, has been found to enhance tool performance at lower temperatures, and also enhances the sealing relationship between the block and the fuel cell stem.

It has been found that the metal stem receiver block allows for increased vaporization/reduced condensation of the fuel. This is important at lower ambient temperatures when flexible fuel transport apparatus are used. In the case of conventional plastic stem receiver blocks, the plastic typically has low thermal conductivity and a relatively low thermal mass. If enough fuel is allowed to vaporize in the stem receiver block, the block can present a cold zone. If the cold zone becomes too cold, fuel flow is limited, inhibiting tool performance.

Another feature of the present system is that the fuel cell has a fuel cell adapter with a relatively large diameter flange. The flange engages arms on the cylinder head, and thus the fuel cell is suspended from the cylinder head, rather than resting on a floor in the fuel cell chamber of the tool housing. This suspension of the fuel cell results in a more consistent relationship between the fuel cell and the corresponding tool actuator mechanism.

Still another feature of the present system is that the adapter is provided with a flexible suspension for supporting the collar on the fuel cell adapter. In one embodiment, this flexible suspension is integrally formed with the adapter, and permits a relatively small, designated amount of vertical travel of the collar, while resisting or inhibiting pivoting, lateral or other non-vertical movement of the collar. By permitting limited vertical movement of the collar, the present fuel cell adapter enhances the engagement between the stem receiver block and the fuel cell valve stem. In one embodiment, the range of vertical motion is approximately no more than 0.020 inch. This enhanced engagement reduces leaks and promotes a full cyclical depression of the valve stem, so that fuel dosing is more consistent. It has been found that prior art systems restricted the stroke of the valve stem, or in some cases, activated the stem at inappropriate times.

More specifically, a fuel delivery system is provided for use with a combustion nailer including a cylinder head frame, a fuel cell chamber and a combustion chamber. The delivery system includes a fuel cell with an outer shell having a closed lower end and an open upper end, a closure crimped over the upper end and defining an opening for accommodating a reciprocating valve stem, a fuel cell adapter frictionally engaging the closure and including a flange configured for suspending the fuel cell in the fuel cell chamber. A stem receiver block is connectable to the cylinder head frame and includes a stem engagement portion configured for directly and sealingly engaging an end of the valve stem, the stem engagement portion being in fluid communication with an internal receiver passage constructed and arranged for delivering fuel to the combustion chamber.

In another embodiment, a fuel delivery system is provided for use with a combustion nailer including a cylinder head frame, the system includes a fuel cell with an outer shell having a closed lower end and an open upper end, a closure crimped over the upper end and defining an opening for accommodating a reciprocating valve stem, a fuel cell adapter frictionally engaging the closure and including a flange configured for suspending the fuel cell in a tool fuel cell chamber. The adapter includes a collar configured for receiving the valve stem and being suspended for restricted vertical movement relative to the flange. A stem receiver block is connectable to the cylinder head frame and includes a stem engagement portion configured for directly and sealingly engaging an end of the valve stem, the stem engagement portion being in fluid communication with an internal receiver passage constructed and arranged for delivering fuel to a combustion chamber.

In yet another embodiment, a fuel cell adapter is provided for use with a fuel cell in conjunction with a combustion nailer having a cylinder head frame. The adapter includes a generally planar flange defining a main opening, a collar suspended in the opening by a suspension connected to the collar and to a ring in the flange defining the opening. The suspension including a plurality of support arms each connected at one end to the collar and at an opposite end to the ring such that the collar is connected to the flange only by the suspension.

DETAILED DESCRIPTION

Figure 1:
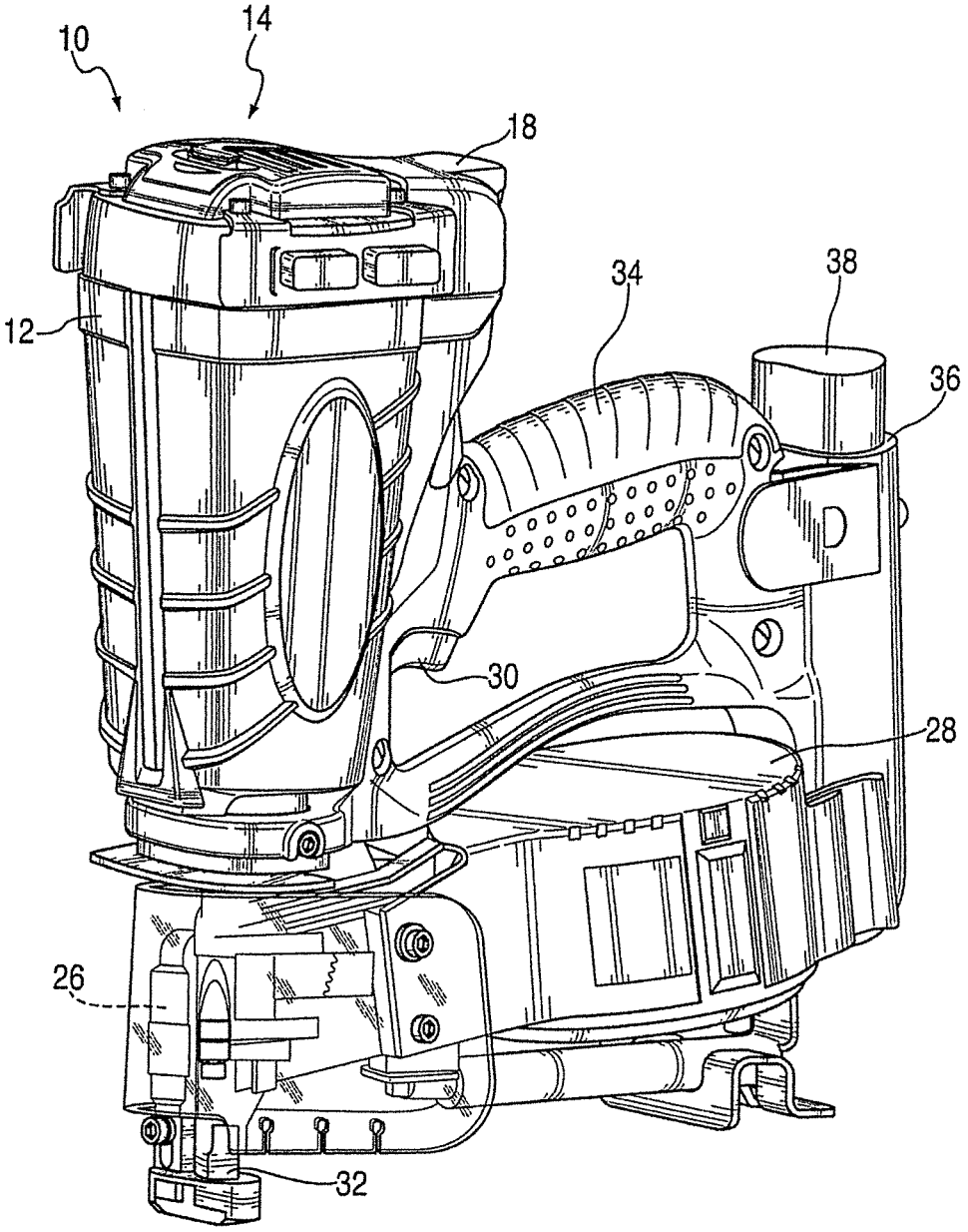
FIG. 1 is a front perspective view of a combustion tool equipped with the present fuel delivery system.
Figure 2:
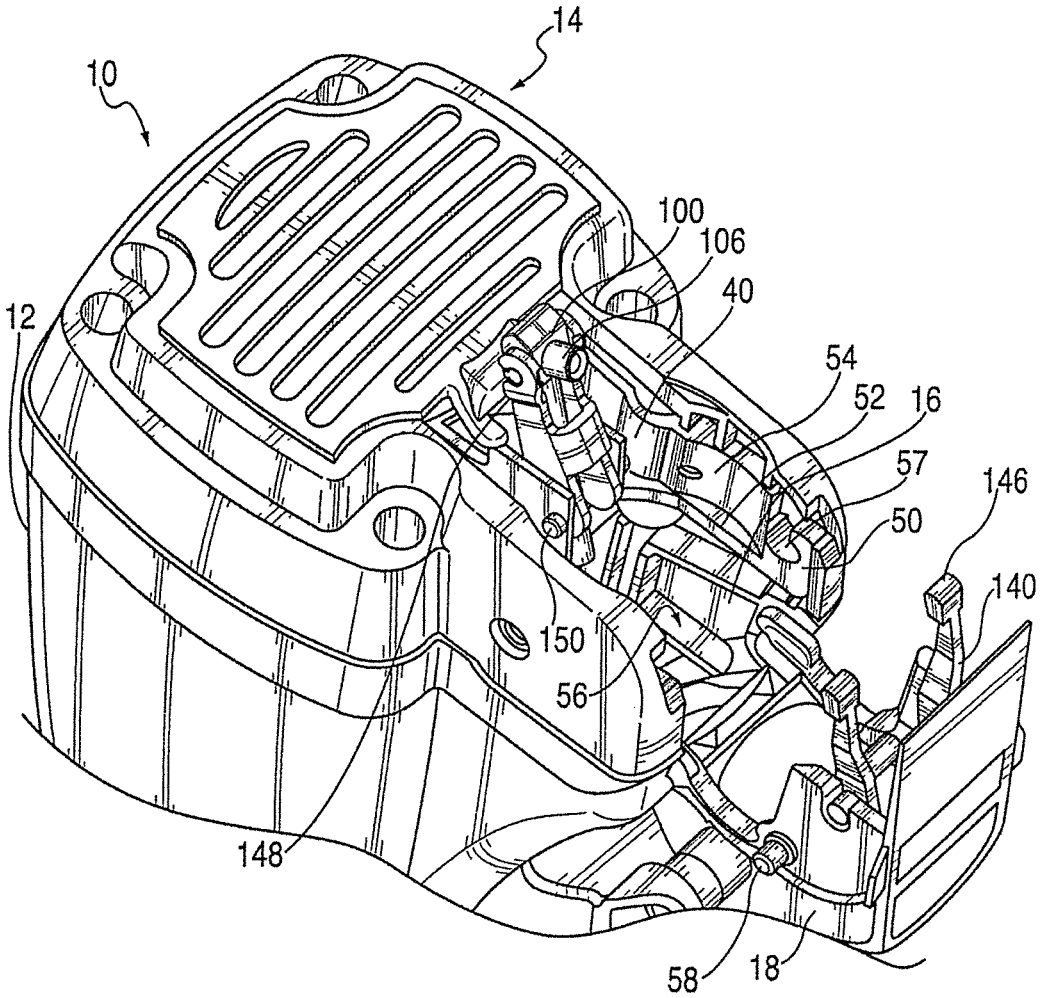
FIG. 2 is a fragmentary top perspective view of the tool of FIG. 1 showing an upper end of the fuel cell chamber open and ready for accommodating a fuel cell.
Figure 3:
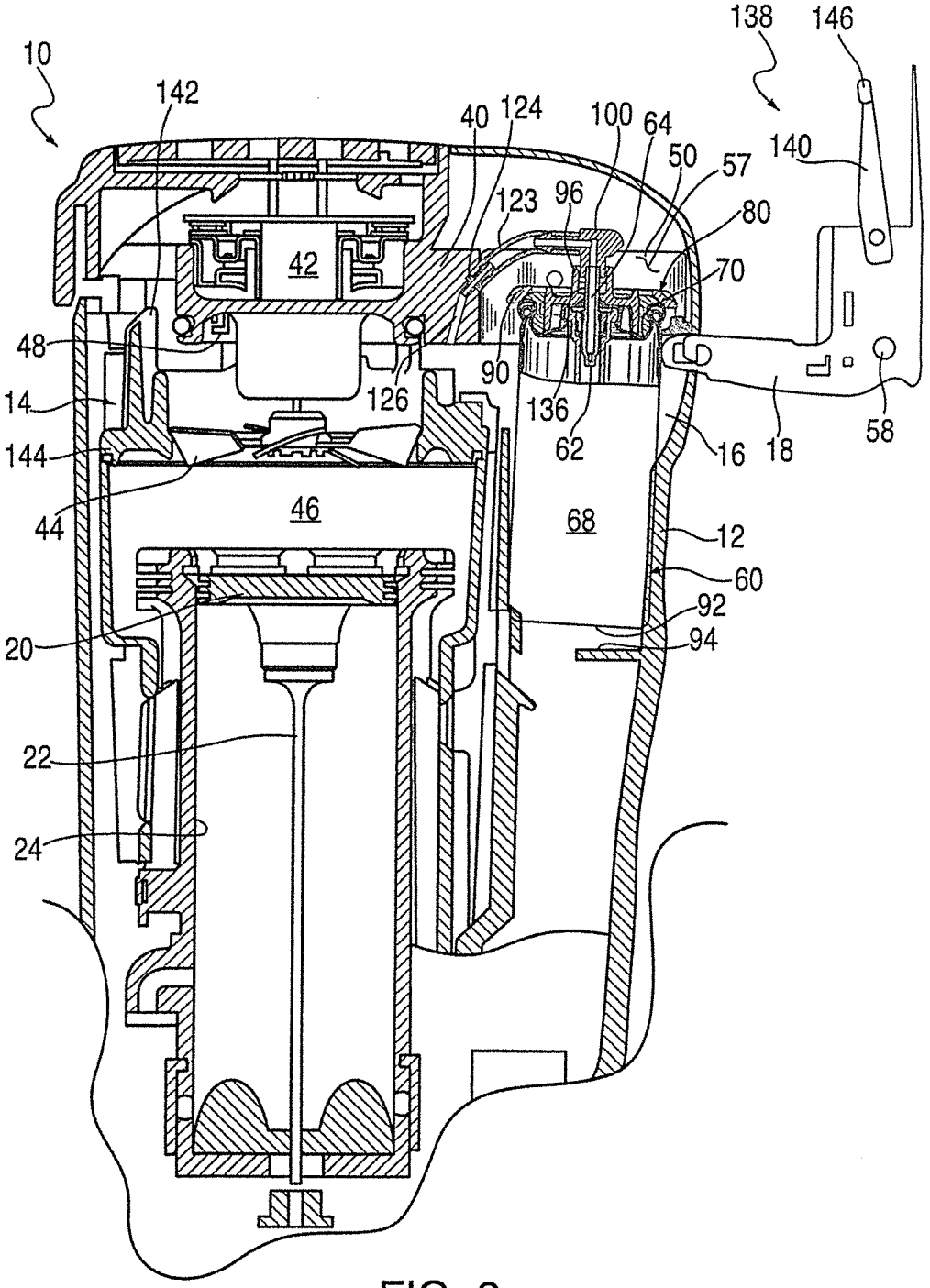
FIG. 3 is a fragmentary vertical section of the tool of FIG. 1 showing the present fuel delivery system.

Referring now to FIGS. 1-3, a combustion nailer is depicted, generally designated 10. As is known in the art, a main tool housing 12 encloses a power source or engine 14 (FIG. 3) and a fuel cell chamber 16. A fuel cell door 18 is pivotally engaged on the housing 12 and is configured to close off the fuel cell chamber 16 during tool operation. The construction and arrangement of such doors 18 is well known in the art.

The power source 14 includes a reciprocating piston 20 (FIG. 3) having a driver blade 22 secured thereto for common movement relative to the power source and within a cylinder 24. A nosepiece 26 (FIG. 1) is secured to a lower end of the power source 14 as is known in the art and provides an attachment point for a fastener magazine 28, here shown as a coil magazine, however other types of magazines such as strip magazines are considered suitable. Fasteners are fed sequentially from the magazine 28 into the nosepiece 26 where they are engaged by the driver blade 22 traveling down a fastener passageway in the nosepiece.

The fasteners are driven into a workpiece or substrate after initiation of a power cycle, initiated in some tools by the operator actuating a trigger 30. A workpiece contact element 32 reciprocates relative to the nosepiece 26 to control tool functions as is known in the art, but is not relevant to the present discussion.

Also provided to the housing 12 is a handle 34 which serves as the mounting point for the trigger 30. A battery chamber 36 (FIG. 1) is also provided to the housing 12 for accommodating at least one battery 38 for powering electronic tool functions such as spark generation, cooling fan operation, electronic fuel injection and/or tool condition sensing as known in the art. The location of the battery chamber 36 may vary depending on the particular nailer configuration.

Figure 4:
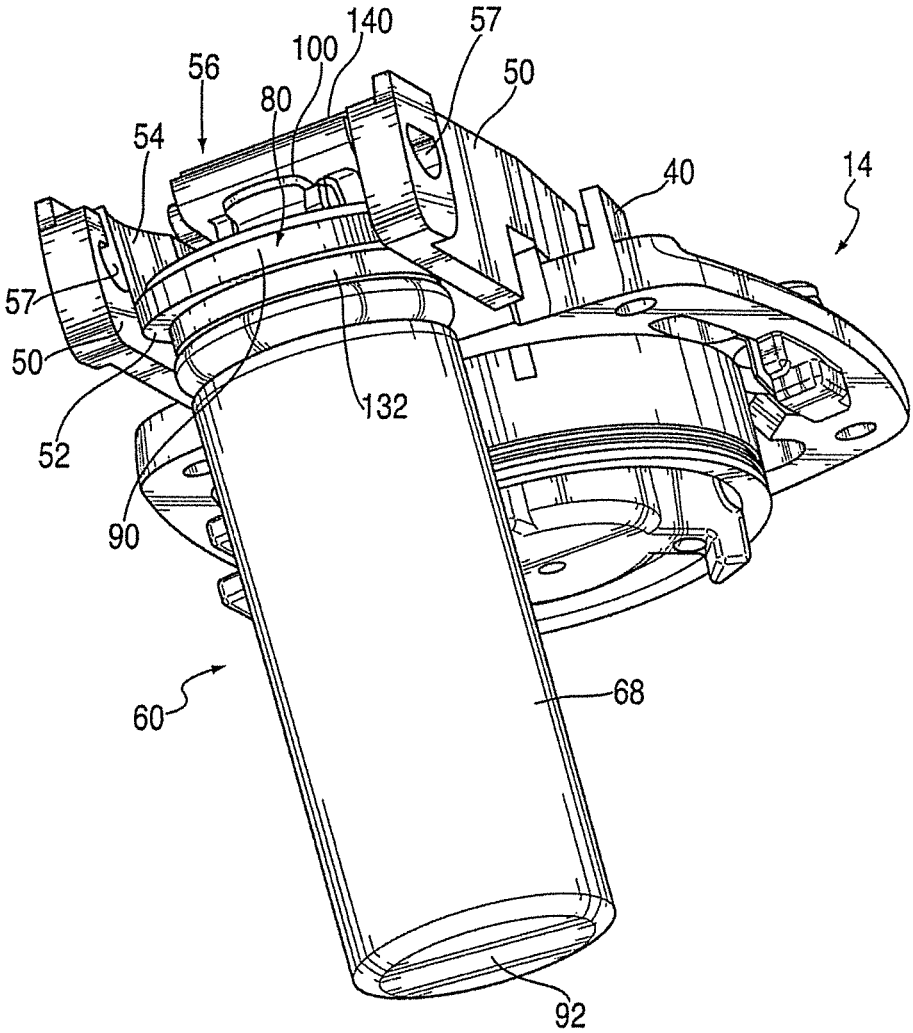
FIG. 4 is a fragmentary bottom perspective view of a fuel cell shown suspended from the cylinder head frame.

Referring now to FIGS. 2-4, an upper end of the power source 14 is defined by a cylinder head 40, serving as the mounting point for a fan motor 42 powering a fan 44 projecting into a combustion chamber 46, and also being the mounting point for a spark generator or spark plug 48. Also included on the cylinder head 40 are two spaced, parallel arms 50 included as part of a cylinder head frame, each having a recessed shelf 52 defined on an inner surface 54 (FIG. 2). A space 56 between the inner surfaces 54 defines an entrance to the fuel cell chamber 16. The entrance 56 is considered part of the fuel cell chamber 16. Ends of the arms 50 have pivot openings 57 for receiving corresponding lugs 58 of the fuel cell door 18.

Referring now to FIGS. 3-6, as described in U.S. Pat. No. 5,263,439, incorporated by reference, inserted into the fuel cell chamber 16 is a fuel cell, generally designated 60, the general construction of which is well known in the art pertaining to combustion tools, and which is configured for removable engagement in the fuel cell chamber 16. The particular construction of the present fuel cell 60, having an internal fuel metering valve 62 (FIGS. 3 and 6) is described in copending U.S. Pat. No. 7,392,922 which has been incorporated by reference. Generally speaking, a fuel valve stem 64 is biased to a closed position, as by a spring (not shown), but when axially depressed, a measured dose of fuel is dispensed. Upon withdrawal of the axial force, the stem 64 resumes its rest position, and a subsequent dose of fuel flows into a metering chamber 66 for the next firing cycle.

Other major components of the fuel cell 60 include a generally cylindrical, close bottomed outer shell 68, and a closure 70 crimped over an open upper end 72 of the shell. As a result of this crimping action, the closure 70 includes a peripheral annular ring 74. Included on the closure 70 is an opening 76 for accommodating the reciprocating valve stem 64.

Referring now to FIGS. 3-6, an important feature of the present fuel cell 60 is an adapter, generally designated 80. A main portion of the adapter 80 is the adapter body 82 including a depending ring 84 which is retained on the fuel cell 60 through engagement with the fuel cell closure 70. A tight friction fit of the adapter 80 with the closure 70 is achieved by at least one radially extending gripping formation 86 which tightly engages an interior surface of the peripheral closure ring 74. The gripping formation 86 defines an annular concave recess or groove 88 which accommodates an inner curved portion of the closure ring and preferably is dimensioned for a looser engagement on the closure ring 74 compared to the formation 86, to accommodate manufacturing variations. In addition, an upper end of the gripping formation 86 includes a radially extending lip 89 configured for engaging an upper surface of the closure ring 74. The depending ring 84 and the formation 86 can be provided in a single closed ring or a series of spaced protrusions.

To reduce the possibility of a user accidentally using a fuel cell not suitable for the present tool 10, the adapter 80 is designed to be extremely difficult to remove from the closure 70. This is accomplished by dimensioning the gripping formation 86 and the radially extending lip to have an extremely tight friction fit with the closure 70. In addition, in that the adapter 80 is preferably molded of a plastic material, a material is selected for stiffness, as well as for fuel resistance, moldability and durability. It is contemplated that acetyl, commonly sold under the trademark Celcon® by Hoechst Celanese, Charlotte N.C., is a preferred material, however other acetyls, polyamids or other fuel resistant plastics may be suitable.

The other main portion of the adapter 80 is a generally planar, disk-shaped flange 90 that is configured for engaging the locating shelves 52 for suspending the fuel cell 60 in the fuel cell chamber 16. It will be seen that the generally planar flange 90 extends beyond an exterior of the fuel cell outer shell 68. In fact, the flange 90 is dimensioned so that once engaged in the locating shelves 52, it is the sole support for the fuel cell 60 in the fuel cell chamber 16. More specifically, once suspended on the shelves 52, a bottom 92 of the fuel cell 60 is disposed above and free of a floor 94 of the fuel cell chamber 16 (FIG. 3). While the particular engagement of the flange 90 on the shelves 52 is described here, it will be appreciated that the adapter 80 may be provided with alternate structures configured for suspending the fuel cell 60 from the cylinder head 40.

Preferably, the flange 90 has a vertically projecting collar 96. The collar is tubular in shape, defining an inner area 98 that surrounds the valve stem 64. Also, the collar 96 projects from the flange 90 a sufficient distance to protect the valve stem 64 from damage or impact. Another feature of the collar 96 is that it is dimensioned for slidingly accommodating reciprocal movement of a stem receiver block 100. More specifically, an upper end 102 of the collar 96, which extends above an uppermost point of the valve stem 64 when the stem is in its uppermost rest position, also defines an end of an inwardly tapering, annular internal chamfer area 104 that facilitates location of a depending stem engagement portion 106 of the stem receiver block 100 upon the valve stem.

Figure 6:
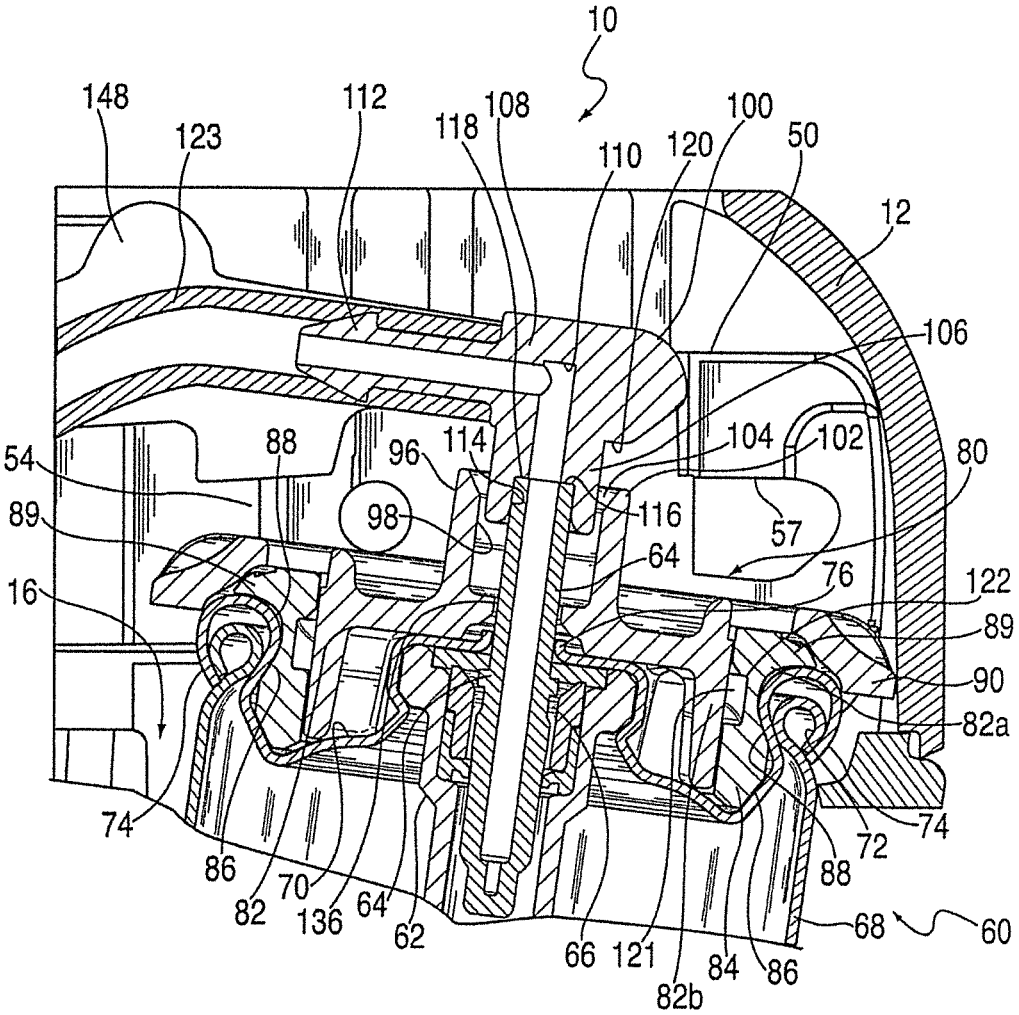
FIG. 6 is an enlarged fragmentary vertical section of the system of FIG. 3.
Figure 7:
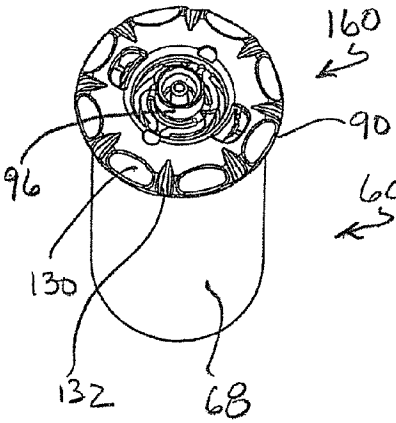
FIG. 7 is a top perspective view of an alternate embodiment of the fuel cell and adapter of FIG. 5.
Figure 9:
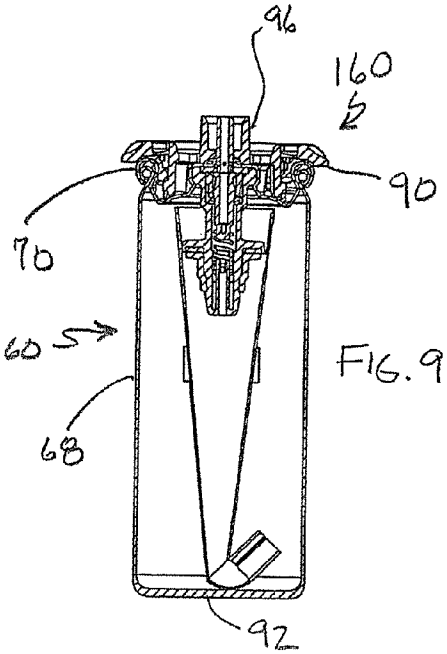
FIG. 9 is a vertical cross-section taken along the line 9-9 of FIG. 8 and in the direction generally indicated.
Figure 8:
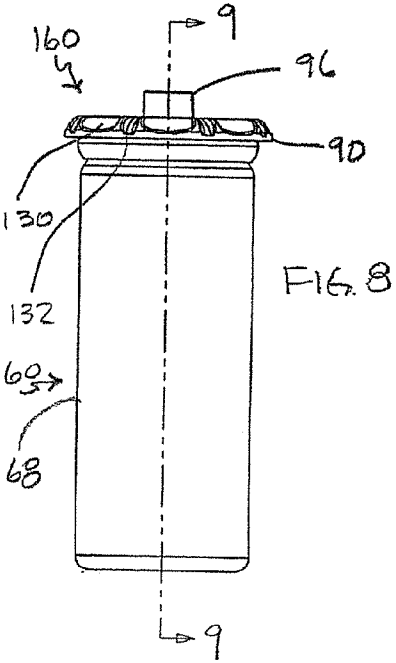
FIG. 8 is a front elevation of the fuel cell of FIG. 7.

Referring now to FIGS. 3 and 6, the stem receiver block 100 includes a block-like body 108 defining an internal fuel passage 110 connected at one end to the stem engagement portion 106, and at an opposite end to a fuel port 112, preferably taking the form of a barbed nozzle. Depending from the body 108, the stem engagement portion 106 defines a stem chamber 114 dimensioned to accommodate an upper end 116 of the stem 64. A counterbored stem stop 118 defines an annular flat or horizontal sealing surface for sealingly receiving the upper stem end 116. It has been found that the horizontal stem stop 118 provides a more positive seal with the upper stem end 116 than provided by conventional fuel cell engagement structures.

Another feature of the present stem receiver block 100 is that a shoulder 120 is defined where an underside of the body 108 meets an upper end of the stem engagement portion 106. This shoulder 120 impacts the upper end 102 of the collar 96 to limit the downward movement of the stem receiver block, and accordingly the valve stem 64. In other words, the shoulder 120 is positioned on the body 108 to define a lowermost point of the stroke of the stem receiver block 100 and the valve stem 64. Due to the construction of the internal metering valve 62, the downward travel of the stem receiver block 100 is sufficient to release a dose of fuel from the metering valve.

In one embodiment, the stem receiver block 100 is made of metal, and more preferably aluminum. It has been found that the aluminum is more resistant to flow variations and the resultant dosage variations over a wider range of ambient temperatures resulting in improved performance in lower temperature environments than conventional plastic stem receiver blocks.

Figure 5:
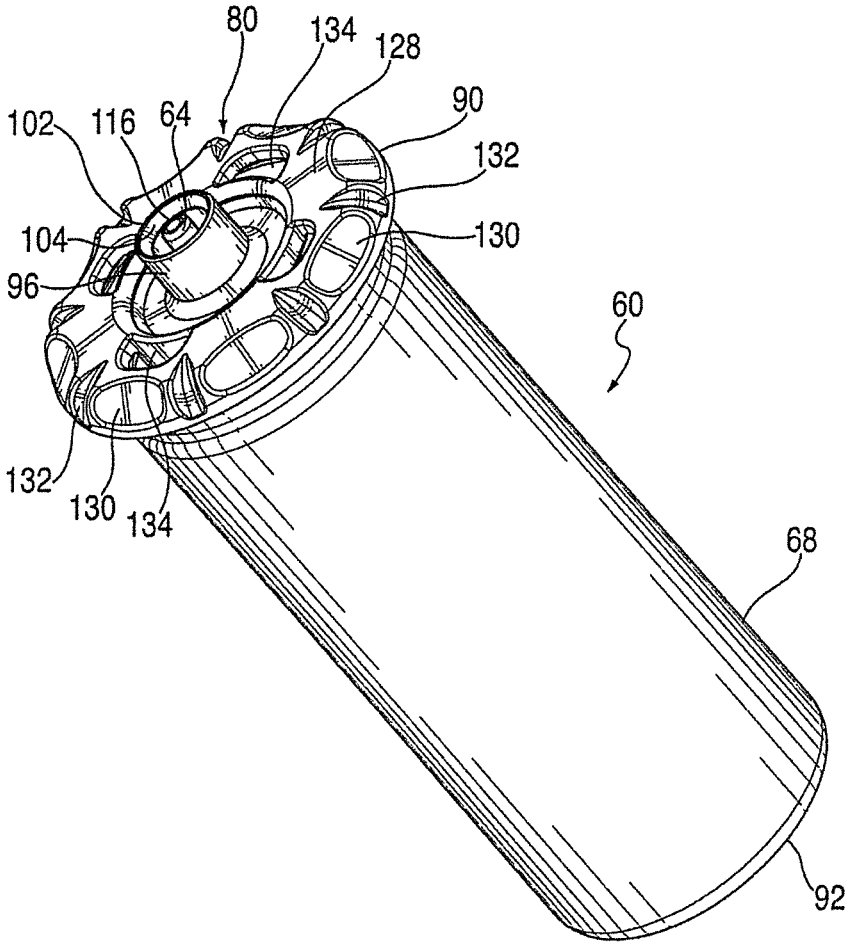
FIG. 5 is a top perspective view of a fuel cell equipped with the present fuel cell adapter.

It is contemplated that the adapter body 82 may be provided in two alternative configurations. In one, as shown in FIGS. 3, 5 and 6, the adapter body 82 has two main components: an outer portion 82*a* including the gripping formation 86, the groove 88 and the lip 89; and an inner portion 82*b*, which includes the collar 96 and the flange 90 and engages the outer portion by a screw-and-twist engagement, where lugs 121 on the inner portion 82*b* engage helical grooves 122 on the outer portion 82*a*. In the other configuration, the adapter body 82 is provided as a single, integral piece.

To complete the connection between the fuel cell valve stem 64 and the combustion chamber 46, a flexible hose or conduit 123 is matingly engaged on the end of the fuel port 112 at one end, and at an opposite end is matingly engaged on a cylinder head inlet fitting 124. Fluid communication between the inlet fitting 124 and the combustion chamber 46 is achieved by a fuel passage 126 in the cylinder head 40.

An advantage of the present adapter 80 is that the combination of the tight frictional engagement between the gripping formation 86 and the radially extending lip 89, the suspension of the fuel cell 60 in the tool using the flange 90 engaging the shelves 52, and the direct engagement of the stem receiver block 100 upon the fuel cell has been found to significantly improve fuel cell efficiency. More specifically, a more consistent fuel dosing is obtained, and performance in colder temperatures has been improved.

Referring now to FIG. 5, an upper surface 128 of the flange 90 is preferably provided with integrally formed depressions 130 and grooves 132 for enhancing gripping and handling by a user. This enhanced gripping is useful when the adapter 80 is provided in two portions 82*a*, 82*b* as described above. In addition, openings 134 are provided for facilitating molding. The specific shapes and dimensions of the depressions 130, the grooves 132 and the openings 134 may vary to suit the particular application, and in some cases may be optionally eliminated.

Referring again to FIGS. 3 and 6, another feature of the present adapter 80 is that the flange 90 defines a stem opening 136 for reciprocally and slidingly accommodating the valve stem 64. It is preferred that the stem opening 136 is dimensioned for defining a tight, sliding engagement with the valve stem such that there is minimal clearance between the opening and the valve stem outer surface. Such tight, sliding engagement reduces the chances for dirt to become lodged in the fuel cell metering valve 62. In addition, the relatively small diameter opening 136 prevents the adapter 80 from being used with incompatible fuel cells, which have larger diameter stems that will not fit through the opening 136. As is known in the art, there are different fuel cell fuel mixtures, and some mixtures are formulated for specific types of tools, and will be less effective if used with incompatible tools.

Referring now to FIGS. 2 and 3, as is known in the art, to dispense a dose of fuel from the fuel cell 60 through the flexible hose 122, a fuel cell actuator assembly is provided and is generally designated 138 which is in operational relationship with fuel cell chamber 16 and is constructed and arranged for exerting an axial force on the valve stem 64. A main component of the actuator 138 is a generally elongate actuator element 140 configured for exerting an axial force on the stem 64, releasing the dose of fuel. In one embodiment, the element 140 is associated with the fuel cell door 18 and is in actual contact with the stem receiver block 100.

As seen in FIGS. 2 and 3, the fuel cell door 18 is pivotally engaged with the pivot points 57 on the cylinder head arms 50. As is well known in the combustion tool art, vertical projections 142 on the reciprocating valve sleeve 144 (which largely defines the combustion chamber 46) engage ends 146 of the actuator element 140 and cause it to rock relative to the fuel cell door 18, thus exerting the periodic axial force on the stem receiver block 100, which in turn axially depresses the valve stem 64. Also shown in FIG. 2 is the pivoting nature of the stem receiver block 100, which is connected to a pivoting arm 148 connected to the cylinder head 40 at points 150. Once the tool 10 is pressed against a workpiece, the workpiece contact element 32 is retracted relative to the cylinder 24, ultimately causing the depression of the valve stem 64, releasing a dose of fuel into the combustion chamber 46 and a resulting combustion or firing of the tool 10.

Referring now to FIGS. 7-14, an alternate embodiment of the adapter 80 is generally designated 160. Components of the adapter 160 shared with the adapter 80 are designated with identical reference numbers. A main difference between the adapters 80 and 160 is that the latter is provided with a flexible suspension for the collar 96. Instead of a solid connection rigidly supporting the collar 96 upon the flange 90, as seen in FIG. 5, the collar in the adapter 160 is suspended relative the flange 90. The suspension, generally designated 162, is defined by a plurality, and preferably four support arms 164, each connected at one end 166 to a ring 168 defined in the flange 90. The ring 168 defines a main opening 170. In one embodiment, the ring 168 projects generally vertically, or in the direction of the longitudinal axis of the fuel cell 60, relative to the flange 90. Other ring configurations are contemplated.

Figure 10:
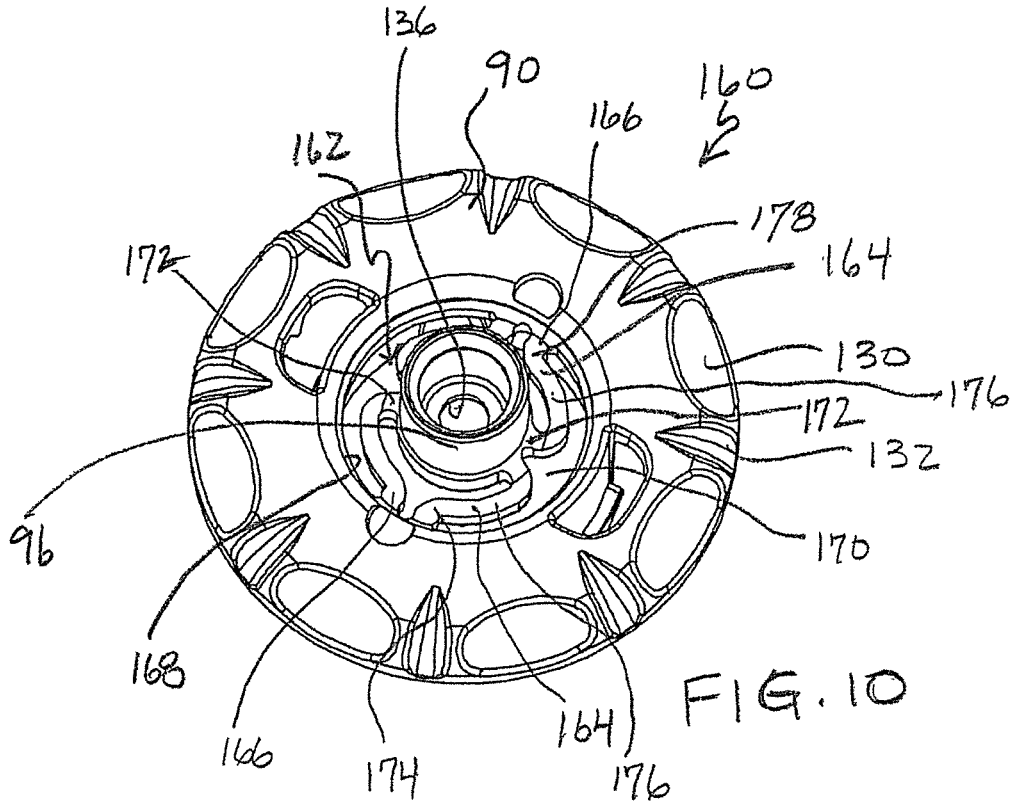
FIG. 10 is a top perspective view of the adapter of FIG. 7.
Figure 11:
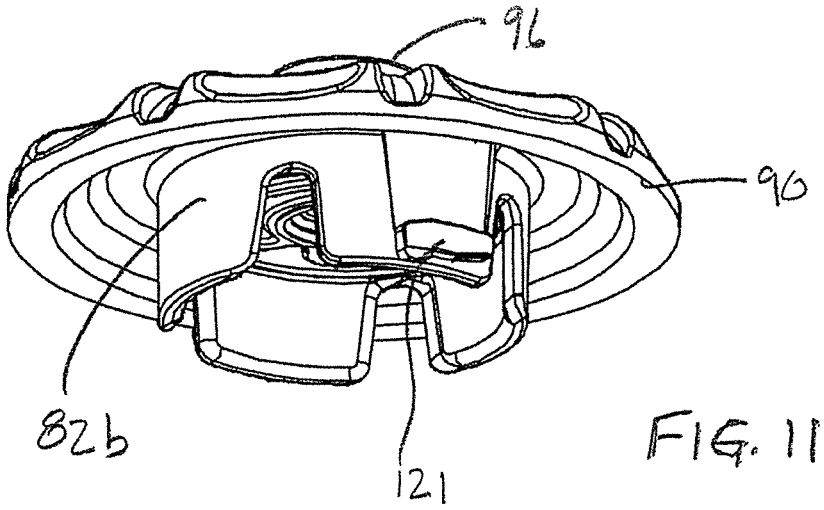
FIG. 11 is a bottom perspective view of the adapter of FIG. 10.
Figure 12:
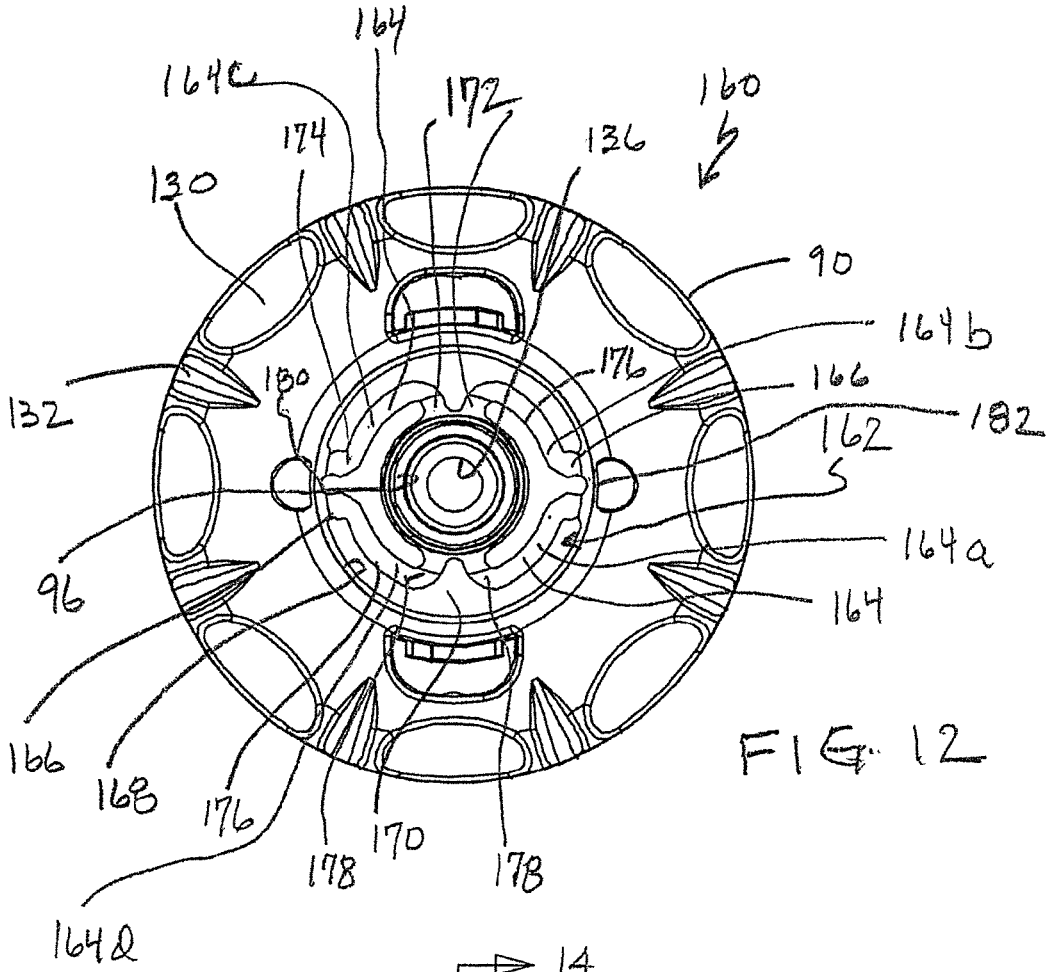
FIG. 12 is an overhead plan view of the adapter of FIG. 10.
Figure 13:
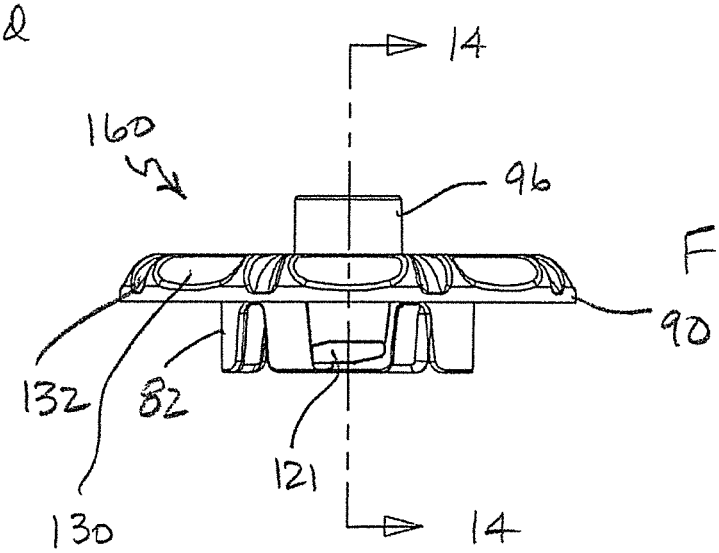
FIG. 13 is a front elevation of the adapter of FIG. 12.
Figure 14:
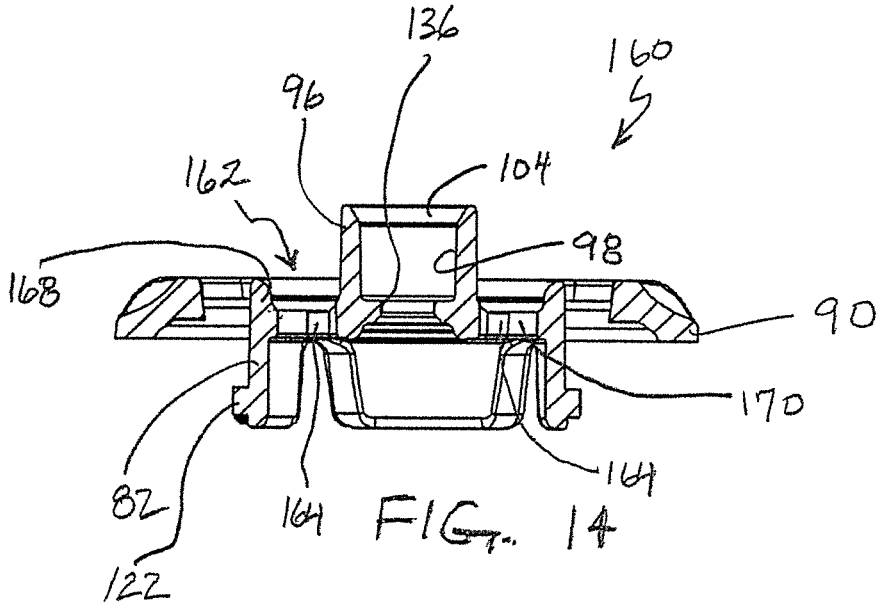
FIG. 14 is a cross-section taken along the line 14-14 of FIG. 13 and in the direction generally indicated.

As best seen in FIGS. 10 and 12, the collar 96 is located generally centrally in the main opening 170, and is connected to the flange 90 only through the support arms 164, which are each connected to the collar at an end 172 opposite the end 166. The arms 164 are generally "S"-shaped, relatively stiff, and are constructed to permit the collar 96 only a limited vertical travel generally no more than 0.020 inch, with small tolerances contemplated for this value. At the same time, the collar 96 is restricted to allow even less non-vertical movement, including pivoting, rotating or laterally relative to the orientation depicted in FIG. 13.

This relatively stiff suspension is achieved by the arms 164 having a generally rectangular vertical cross-section, and including three main portions: a first or ring portion 174 projecting generally parallel to a diameter of the opening 170; a second or mid portion 176 being gently arcuate and generally following a curve of the generally cylindrical perimeter of the collar 96 in spaced orientation; and a third or collar portion 178 curving abruptly from the mid portion and contacting the collar in a direction generally parallel to a diameter of the collar.

Referring now to FIG. 12, it will be seen that the ring portion 174 and the collar portion 178 are oriented at generally 90° from each other. Further, the arms 164 generally surround the collar 90, and the ring ends 166 of adjacent support arms 164*a* and 164*b* are closely adjacent each other, as are the ring ends 166 of adjacent support arms 164*c* and 164*d*. As a result, the collar 96 can be said to be suspended from mainly two, generally diametrically-opposed support points 180, 182. Also, the arms 164*a*, 164*b* are oriented to be mirror-images of arms 164*c*, 164*d*.

Figure 15:
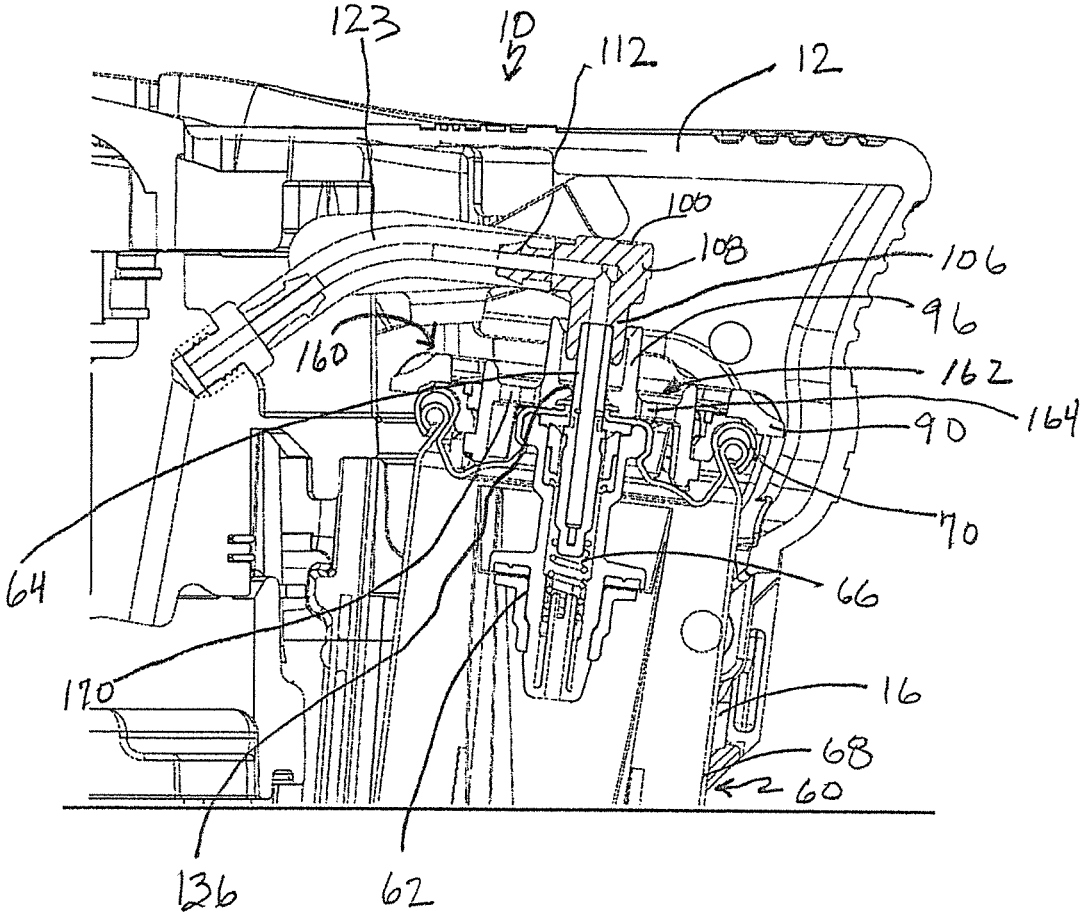
FIG. 15 is a fragmentary vertical section of a nailer equipped with the fuel cell of FIG. 7 in the rest position.
Figure 16:
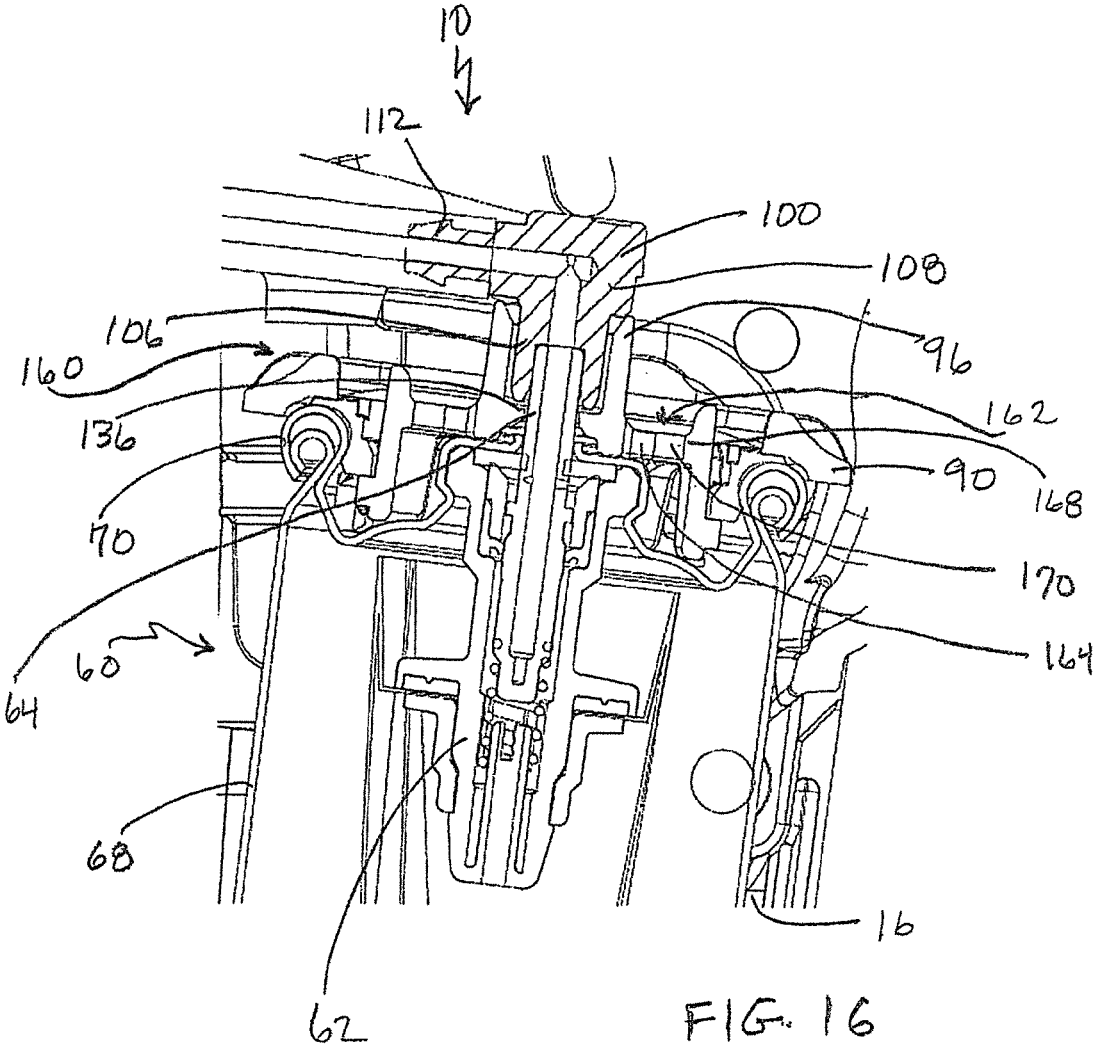
FIG. 16 is a fragmentary vertical section of the nailer of FIG. 14 shown in the fuel dispensing position.

Referring now to FIGS. 15 and 16, it will be seen that the present adapter 160 promotes positive, sliding engagement between the stem receiver block 100 and the valve stem 64. It has been found that the relatively stiff suspension 162, featuring the design incorporating limited vertical movement of the collar 96 relative to the flange 90, and even further restricted non-vertical movement, improves the efficiency of the actuation of the valve stem 64 for obtaining more consistent fuel delivery.

While a particular embodiment of the present interface for a fuel delivery system for a combustion nailer has been shown and described, it will be appreciated by those skilled in the art that changes and modifications may be made thereto without departing from the invention in its broader aspects and as set forth in the following claims.

What is claimed is:

1. A fuel delivery system constructed and arranged for use with a combustion fastener driver including a cylinder head frame, a combustion chamber, and a housing defining a fuel cell chamber, said fuel delivery system comprising:

a fuel cell with an outer shell having a closed lower end and an open upper end;

a closure crimped over said upper end and defining an opening sized to accommodate a reciprocatable valve stem;

a fuel cell adapter frictionally engaged to said closure and including a flange configured to suspend said fuel cell in the fuel cell chamber, said fuel cell adapter including a collar defining an opening sized to receive said valve stem, wherein the collar is suspended for restricted vertical movement relative to said flange; and a stem receiver block connectable to the cylinder head frame and including a stem engagement portion configured to directly and sealingly engage an end of said valve stem, said stem engagement portion being in fluid communication with an internal receiver passage constructed and arranged to deliver fuel to the combustion chamber.

2. The fuel delivery system of claim 1, wherein said stem receiver block includes a body defining said internal fuel passage, and wherein said stem engagement portion depends from said body and defines a stem chamber.

3. The fuel delivery system of claim 2, wherein said stem chamber includes a stem stop defining a generally horizontal surface configured to engage an upper end of the valve stem.

4. The fuel delivery system of claim 2, wherein said collar is dimensioned to slidingly accommodate reciprocal movement of said stem engagement portion.

5. The fuel delivery system of claim 1, wherein said flange on said fuel cell adapter defines a main opening in which said collar is suspended, wherein said collar is dimensioned to slidingly accommodate a stem engagement portion of said stem receiver block and to guide said stem engagement portion as it engages said valve stem.

6. The fuel delivery system of claim 5, wherein said collar is suspended relative to said flange to enable vertical movement relative to the flange in the general range of 0.020 inch and to restrict non-vertical movement of said collar relative to the flange.

7. The fuel delivery system of claim 5, wherein said collar is suspended relative to said flange by a plurality of arms, each arm connected at one end to said collar and at an opposite end to a ring on said flange, the ring defining said main opening.

8. The fuel delivery system of claim 7, wherein said plurality of arms includes four arms constructed and arranged to generally surround said collar.

9. The fuel delivery system of claim 7, wherein said plurality of arms includes four arms suspended from two main support points on the ring.

10. The fuel delivery system of claim 7, wherein said plurality of arms each include a ring portion, a mid portion, and a collar portion.

11. The fuel delivery system of claim 1, wherein said stem receiver block is made of metal.

12. The fuel delivery system of claim 1 wherein said collar has an upper end extending above an upper stem end when said valve stem is in a rest position.

13. The fuel delivery system of claim 1 wherein said collar includes a radially inwardly tapering internal chamfer that facilitates locating said stem receiver block upon the valve stem.

14. The fuel delivery system of claim 1 wherein said collar is dimensioned to define a stroke of the stem receiver block and the valve stem.

15. A fuel cell adapter for use with a fuel cell, said adapter comprising:

a generally planar flange including a ring defining a main opening; and a collar suspended in said main opening by a suspension connected to said collar and to the ring, said suspension including a plurality of support arms each connected at one end to said collar and at an opposite end to said ring such that said collar is connected to said flange only by said suspension.

16. The adapter of claim 15 wherein each of the support arms is constructed to enable vertical movement of the collar relative to the flange in the range of 0.020 inch and to restrict non-vertical movement of the collar relative to the flange.

17. The adapter of claim 15 wherein said plurality of support arms include four support arms, each generally "S"-shaped and including a mid portion generally arcuate and generally following a curve of a perimeter of said collar.

18. The adapter of claim 17 wherein said support arms have ends attached to said ring such that two pairs of such support arms each have said ends closely attached at said ring, so that said collar is suspended in said main opening at two generally diametrically opposed support points.

* * * * *